United States Patent [19]

Moggert

[11] Patent Number: 5,014,590

[45] Date of Patent: May 14, 1991

[54] DEVICE FOR EJECTING SUBMUNITION

[75] Inventor: Wolf-Dieter Moggert, Munich, Fed. Rep. of Germany

[73] Assignee: Messerschmitt-Bölkow-Blohm GmbH, Munich, Fed. Rep. of Germany

[21] Appl. No.: 466,710

[22] Filed: Dec. 29, 1989

Related U.S. Application Data

[63] Continuation of Ser. No. 118,771, Oct. 19, 1987, abandoned.

[30] Foreign Application Priority Data

Oct. 23, 1986 [DE] Fed. Rep. of Germany ..... 3636055

[51] Int. Cl.[5] ..... B64D 1/04; F42B 13/50

[52] U.S. Cl. ..... 89/1.57; 89/1.51; 89/1.56

[58] Field of Search ..... 89/1.11, 1.56, 1.57, 89/1.51, 1.6, 1.818

[56] References Cited

U.S. PATENT DOCUMENTS

| | | | |
|---|---|---|---|
| 1,658,790 | 2/1928 | Hammond | 89/1.57 |
| 3,608,426 | 9/1971 | Jackson | 89/1.51 |
| 3,619,792 | 11/1971 | Capeci et al. | 89/1.56 |
| 4,172,407 | 10/1979 | Wentink | 89/1.56 |
| 4,307,650 | 12/1981 | Kuesters et al. | 89/1.56 |
| 4,444,085 | 4/1984 | Dragonuk | 89/1.51 |

*Primary Examiner*—David H. Brown

*Attorney, Agent, or Firm*—Toren, McGeady & Associates

[57] ABSTRACT

A device for ejecting submunition from a scattering vessel with a plurality of ejecting tubes which receive this submunition, has one or more compressed-gas generators being assigned to these ejecting tubes for the purpose of an ejection which is uniform or variable with respect to time. Such a device regulates the pattern of the submunition in accordance with given conditions.

5 Claims, 2 Drawing Sheets

DEVICE FOR EJECTING SUBMUNITION

Figure 1:
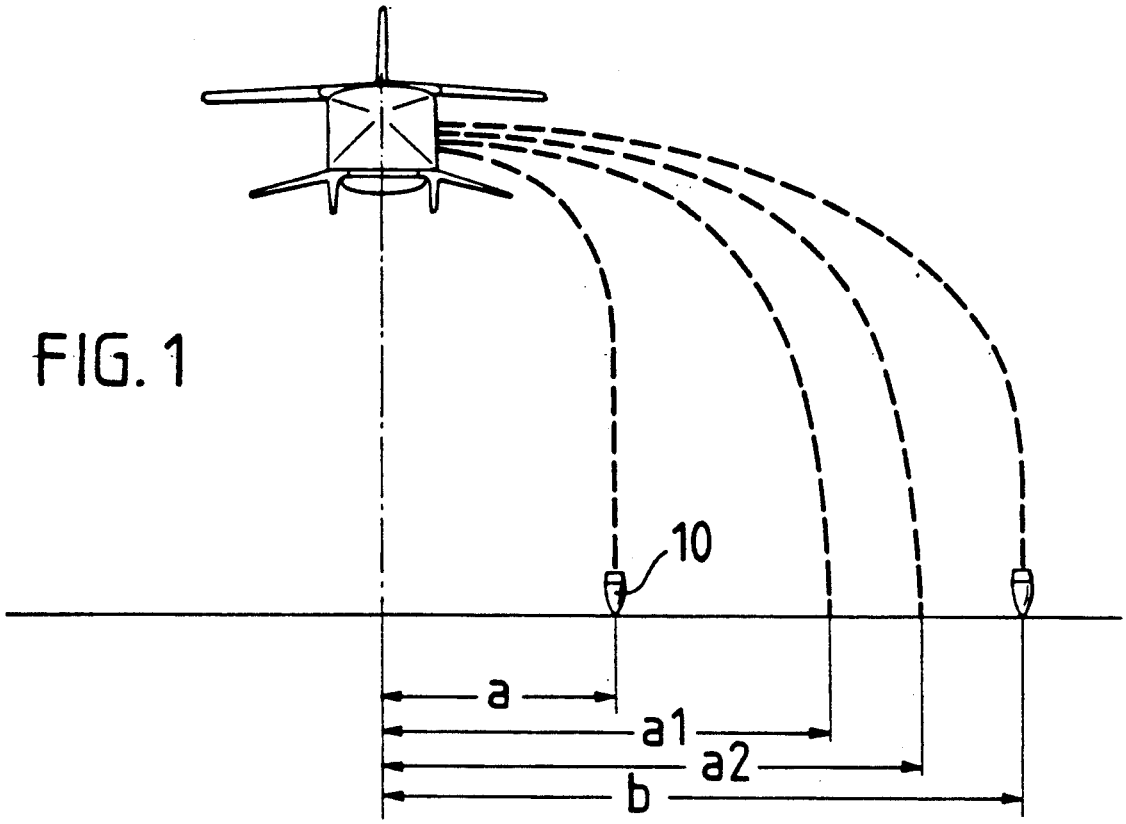

This is a continuation of Ser. No. 118,771, filed Oct. 19, 1987 now abandoned.

The invention is directed to a device for ejecting submunitions from a scattering vessel with a plurality of ejecting tubes which receive these submunitions, and one or more compressed gas generators for effecting ejection which is uniform or variable with respect to times.

Such a device is known from the Applicant's DE-PS 35 00 163. The propelling pistons of the individual tubes are acted upon by the residual gas of the previously ignited launcher tube and ejection speeds of different magnitudes are used for the scattering ammunition from the individual ejecting tubes for the purpose of uniformly covering a scattering surface in a transverse direction relative to the movement direction of the transported scattering vessel. The active bodies or submunitions ejected at both sides at the highest velocity cover the outer edges of the scattering field, and the submunition which is ejected at lower velocities impacts on the scattering field at uniform distances from the outermost edges toward the center.

The present invention has the object of providing a device of the aforementioned type based on this prior art, whose scattering range is variably adjustable and whose adaptability to given conditions can be improved. In other words, the scattering patterns should be adjustable, for example, to the terrain, in more various ways—for example, so as to exclude waterways, etc.

This object is met by means for controlling pressure relative to time in a compressed gas space. The control is provided by a programming device. Constructions and an embodiment example is treated in the description. More detailed explanations can be gathered from the drawing.

Figure 2:
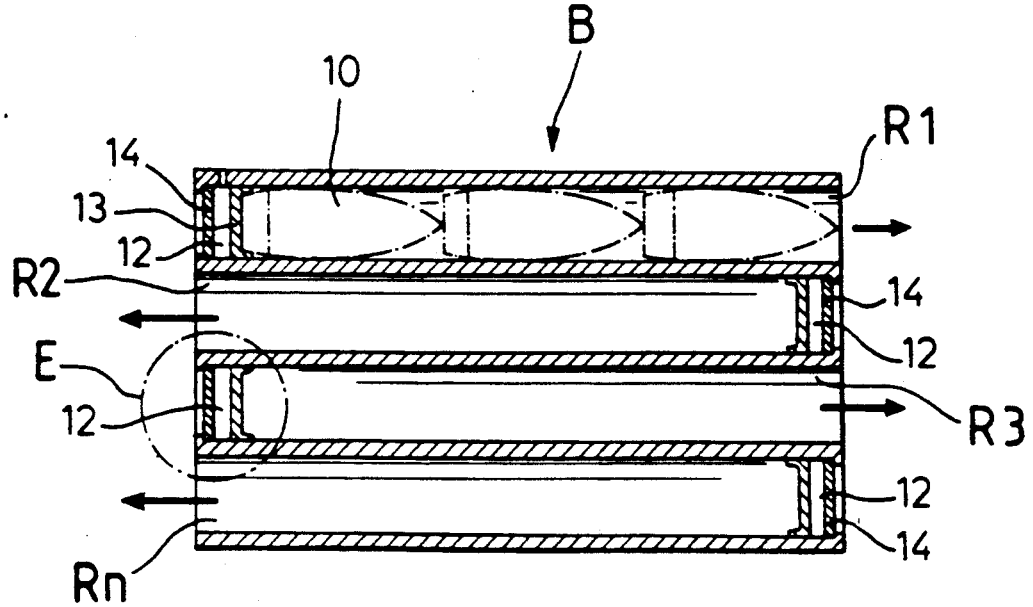
Figure 3:
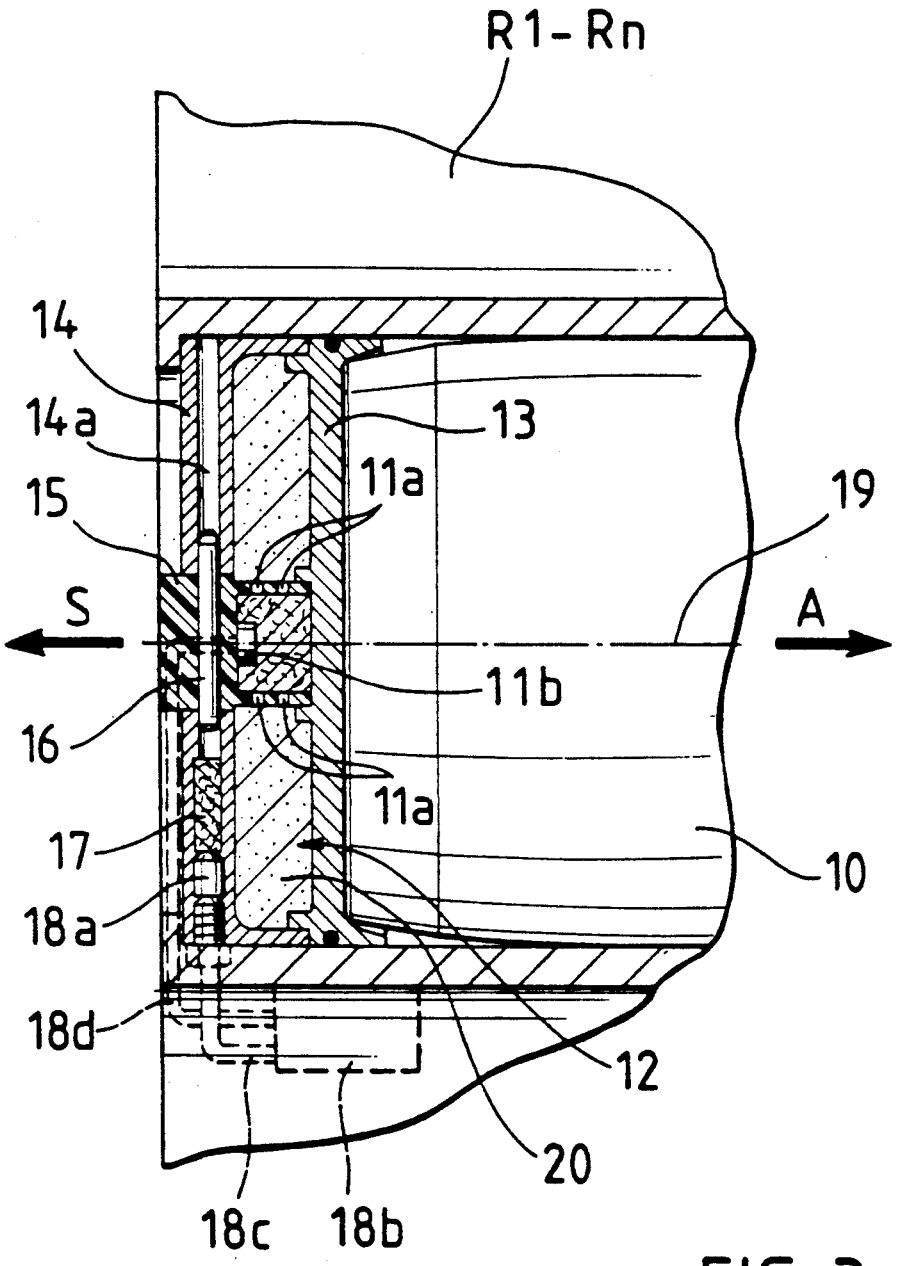

FIG. 1 shows a schematic drawing of a flying device with scattering vessel and the flight paths of the submunitions which are ejected at different velocities, FIG. 2 shows a cross section through the embodiment example of a scattering vessel ejecting on both sides, in a schematic presentation, and FIG. 3 shows a partial cross section of the end part of an ejecting tube according to detail E of FIG. 2 in an embodiment example.

As can be seen from FIG. 1, submunition or individual projectiles 10 from a flying device with suspended or installed scattering vessel forms a scattering field, the submunition or individual projectiles 10 having different firing ranges "a, a1, a2 to b". This object is already met by the device indicated in the prior art. But a uniform "scattering pattern" is produced in this case. The object of the present invention, however, is to make the scattering pattern variable so that, for example, waterways can be left out, front positions at various distances can be covered simultaneously, etc. For this purpose, the general inventive concept provides that an adjustable igniter is arranged, which, when activated in a time-delayed manner, achieves the respective desired firing range "a to $b_n$".

The corresponding device is shown in FIGS. 2 and 3. As already mentioned, the scattering vessel B consists of a plurality of ejecting tubes R1 to Rn. The submunition 10 is stored in the ejecting tubes, each tube having a propelling piston 13 which ejects the submunition by means of the compressed gas which is produced by means of a powder charge 20 in the compressed gas space 12. The powder charge 20 is ignited—via the boreholes 11*a*—by means of the igniting device 11*b* and the igniting charge 11. The device, which is described in the following, is provided in order that each submunition 10 has a desired firing range, wherein this can be a matter of the submunition 10 within an ejecting tube R1, R2, etc., or submunition 10 from tubes R1 to R2, etc.

Each of the ejecting tubes R1 to Rn has a tube closing plate 14 at its end opposite the ejecting opening, which tube closing plate has a borehole in its central axis 19 which is sealed with a plug 15. A bearing borehole 14*a*, which is likewise guided through the sealing plug so as to fit exactly with respect to dimensioning and position, is arranged in the radial axis of the tube closing plate 14. A locking bolt 16, which locks the sealing plug 15 with the tube closing plate 14, is located in this borehole 14*a*. Accordingly, a gastight compressed gas space 12 is formed in conjunction with the propelling piston 13 located against the submunition 10. In the normal ejecting process, the compressed gas formed by the powder charge 20 flows into this compressed gas space 12, presses on the propelling piston 13, and the latter pushes the submunition out of the ejecting tube R1, R2, etc. in axial direction A at a high velocity. If different ejecting velocities and, accordingly, different scattering patterns or hit ranges are to be achieved, the locking bolt 16 is pressed into the free space of the bearing borehole 14*a* by means of a powder charge 17, which is likewise arranged in the bearing borehole 14*a* and is activated by means of an igniting device 18*a*. The propelling charge pressure in the compressed gas space 12 now ejects the sealing plug 15 from its unlocked position out of the tube closing plate in direction S. The bearing borehole of the sealing plug is accordingly opened and a portion of the compressed gas escapes from the gas compressed space 12, also in direction S, so that none of the desired ranges "a to b" effects a corresponding increased acceleration of the submunitions 10.

The ignition of the powder charge 17 by means of the igniting device 18*a* can be effected either by means of manual presetting or, according to a special embodiment example, by means of a programming device 18*b* in a fully automatic manner. The programming device 18*b* comprises not only an ignition line 18*c* for the igniting device 18*a*, but also an ignition line 18*d* for the igniting device 11*b*. In this way, a program can be input in the program unit prior to the beginning of the mission with respect to the given geographical conditions or the enemy position, the battle plan, etc. However, the ignition times can also be controlled by means of the onboard computer, which conveys enemy location target recognition to the igniting devices 18*a* on the basis of the distance measurements which are accordingly effected.

I claim:

1. Device for the ejection of submunitions or individual projectiles from a scattering vessel comprising a plurality of ejecting tubes containing said submunitions, at least one compressed-gas producer and a compressed gas space in each of said ejecting tubes, wherein the improvement comprises a tube closing plate in one end of said ejecting tubes, means (15, 16, 17) for selectively reducing the pressure in each said compressed gas space (12), said means (15, 16, 17) being controlled with respect to time by a programming device (18*b*) associated with each said ejecting tube (R1–Rn) at the tube closing plate (14) end thereof for one of the controlled uniform or variable ejection with respect to time of said submunitions in order to achieve a graduated dispensing of said submunitions.

2. Device according to claim 1, wherein said means is located in the tube closing plate (14), a central axis for each said ejecting tube, a sealing plug (15) inserted on said central axis (19) in said tube closing plate and secured therein by a locking bolt (16) located in a bearing borehole (14*a*) extending in said closing plate transversely of the central axis (19), a powder charge (17) positioned in said bearing borehole, and an igniting device for igniting said powder charge.

3. Device according to claims 1 or 2, wherein the igniting device (18*a*) is activated by said programming unit (18*b*).

4. Device according to claim 1 wherein said plurality of ejecting tubes extend generally in parallel relation and each has an open end and a closed end with said tube closing plate (14) located at the closed end, a propelling piston (13) located within each said ejecting tube and spaced closely from said tube closing plate (14) and forming therebetween said compressed gas space, and said compressed gas producer comprises a powder charge (20) located within said compressed gas space (12).

5. Device as set forth in claim 4, wherein each said ejecting tube has a central axis with said central axis passing through said tube closing plate, a sealing plug (15) fitted in and extending through said tube closing plate (14) and located on said central axis, a bearing borehole (14*a*) extending through said tube closing plate (14) transversely of said central axis (19) and extending through said plug (15), a locking bolt (16) located within said bearing borehole (14*a*) and extending through said plug (15) for locking said plug with said tube closing plate, a second powder charge (17) located within said bearing bore hole (14*a*), and an igniting device (18*a*) located in said bearing borehole (14*a*) and positioned next to said second powder charge (17) for displacing said locking bolt (16) out of locking engagement with said plug (15), and said programming device (18*b*) connected to said igniting device (18*a*).

* * * * *